US006359244B1

(12) United States Patent
Freimuth

(10) Patent No.: US 6,359,244 B1
(45) Date of Patent: Mar. 19, 2002

(54) SWITCHGEAR UNIT HAVING A LEADING AUXILIARY SWITCH

(75) Inventor: Michael Freimuth, Hirschau (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/555,792

(22) PCT Filed: Nov. 23, 1998

(86) PCT No.: PCT/DE98/03452

§ 371 Date: Aug. 2, 2000

§ 102(e) Date: Aug. 2, 2000

(87) PCT Pub. No.: WO99/30340

PCT Pub. Date: Jun. 17, 1999

(30) Foreign Application Priority Data

Dec. 5, 1997 (DE) ..... 197 54 071

(51) Int. Cl.[7] ..... H01H 9/20

(52) U.S. Cl. ..... 200/50.4; 200/330; 200/334; 335/13; 335/18; 335/172

(58) Field of Search ..... 200/17 R, 400, 200/401, 329, 330, 331, 334, 50.37, 50.4; 335/8–16, 172, 17, 18, 132

(56) References Cited

U.S. PATENT DOCUMENTS

| | | | | | |
|---|---|---|---|---|---|
| 5,122,771 | A | * | 6/1992 | Panus et al. | 335/172 |
| 5,331,301 | A | * | 7/1994 | Glennon et al. | 335/20 |
| 5,552,755 | A | * | 9/1996 | Fello et al. | 335/18 |
| 5,774,031 | A | * | 6/1998 | Linzenich et al. | 335/172 |
| 6,104,265 | A | * | 8/2000 | Maloney et al. | 335/13 |

FOREIGN PATENT DOCUMENTS

| | | | |
|---|---|---|---|
| DE | 78 23 619 | 11/1978 | H01H/71/46 |
| DE | 38 20 113 | 11/1989 | H01H/71/46 |
| DE | 39 20 822 | 1/1991 | H01H/71/46 |
| DE | 2 684 231 | 5/1993 | H01H/9/26 |

* cited by examiner

*Primary Examiner*—Michael Friedhofer
(74) *Attorney, Agent, or Firm*—White & Case LLP

(57) ABSTRACT

The auxiliary switch (2) has a slide (5) with a gate (14) as an actuating element that engages with the reversing lever (13) acting upon the contact carrier (11). After a first actuation stage, in which the slide (5) pushes the contact carrier (11) into the ON position, the actuating element of a basic switching device (1) is actuated when pushing is continued.

7 Claims, 2 Drawing Sheets

SWITCHGEAR UNIT HAVING A LEADING AUXILIARY SWITCH

FIELD OF THE INVENTION

The present invention relates to a switchgear unit which has a switching device having a first actuating element and a leading auxiliary switch coupled to the switching device having a second actuating element.

BACKGROUND INFORMATION

A generic switchgear unit can be acquired from switching device manufacturers. The switching device is a power circuit-breaker having a rocker bar built onto its edge as an actuating element. The rocker bar permits gripping of the finger-grip knob of an undervoltage release having a leading auxiliary switch. The finger-grip knob is provided with a leading play so that the leading auxiliary switch is switched on first before the closing cycle of the power circuit-breaker begins. Axes of rotation of the rocker bar of the power circuit-breaker and the finger-grip knob of the leading auxiliary switch are both situated on one line.

SUMMARY

An object of the present invention is to create a switchgear unit which has a simple closing operation with only one movement of the hand if possible.

This object is achieved by providing a second actuating element as a slide having a gate which engages with a reversing lever and determines the position of the reversing lever on actuation of the slide so that in a first slide actuating phase, the reversing lever brings a contact carrier with which it is in operative connection into the ON position of moving contacts having fixed contacts of the leading auxiliary switch. In a subsequent second slide actuating phase, the ON position of the reversing lever is retained while at the same time the slide of the first actuating element is actuated.

DETAILED DESCRIPTION OF THE DRAWINGS

Figure 1:
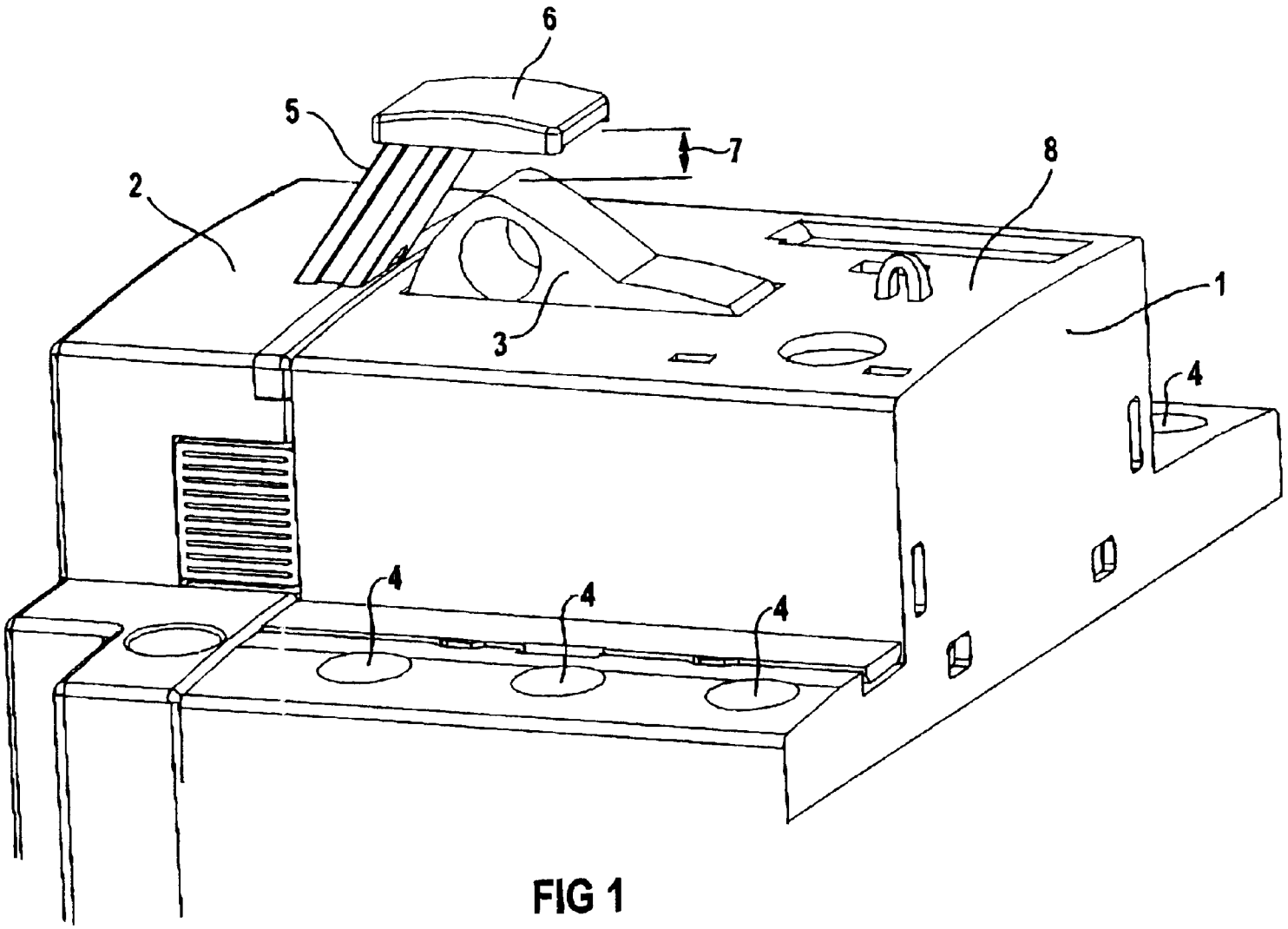
FIG. 1: an external view of a switchgear unit according shows the present invention having a switching device and a leading auxiliary switch coupled to it.

FIG. 1 shows a switchgear unit composed of a switching device 1 and an undervoltage release having a leading auxiliary switch 2. The operating element of switching device 1 is designed as a rocker 3 whose axis of rotation runs across two terminal rows 4, only the front of which is shown here. The actuating element of auxiliary switch 2 is designed as a slide 5 having a pressure face 6 which projects at least partially over rocker 3. Pressure face 6 is at a distance 7 from rocker 3. Distance 7 represents the leading distance by which slide 5 must approach rocker 3 before actuating rocker 3. To travel this distance 7, the direction of actuation of slide 5 has a component parallel to the mounting wall of auxiliary switch 2. Another component of the direction of actuation of slide 5 lies in a plane parallel to front wall 8 of switching device 1. This facilitates the closing operation in actuating rocker 3.

Figure 2:
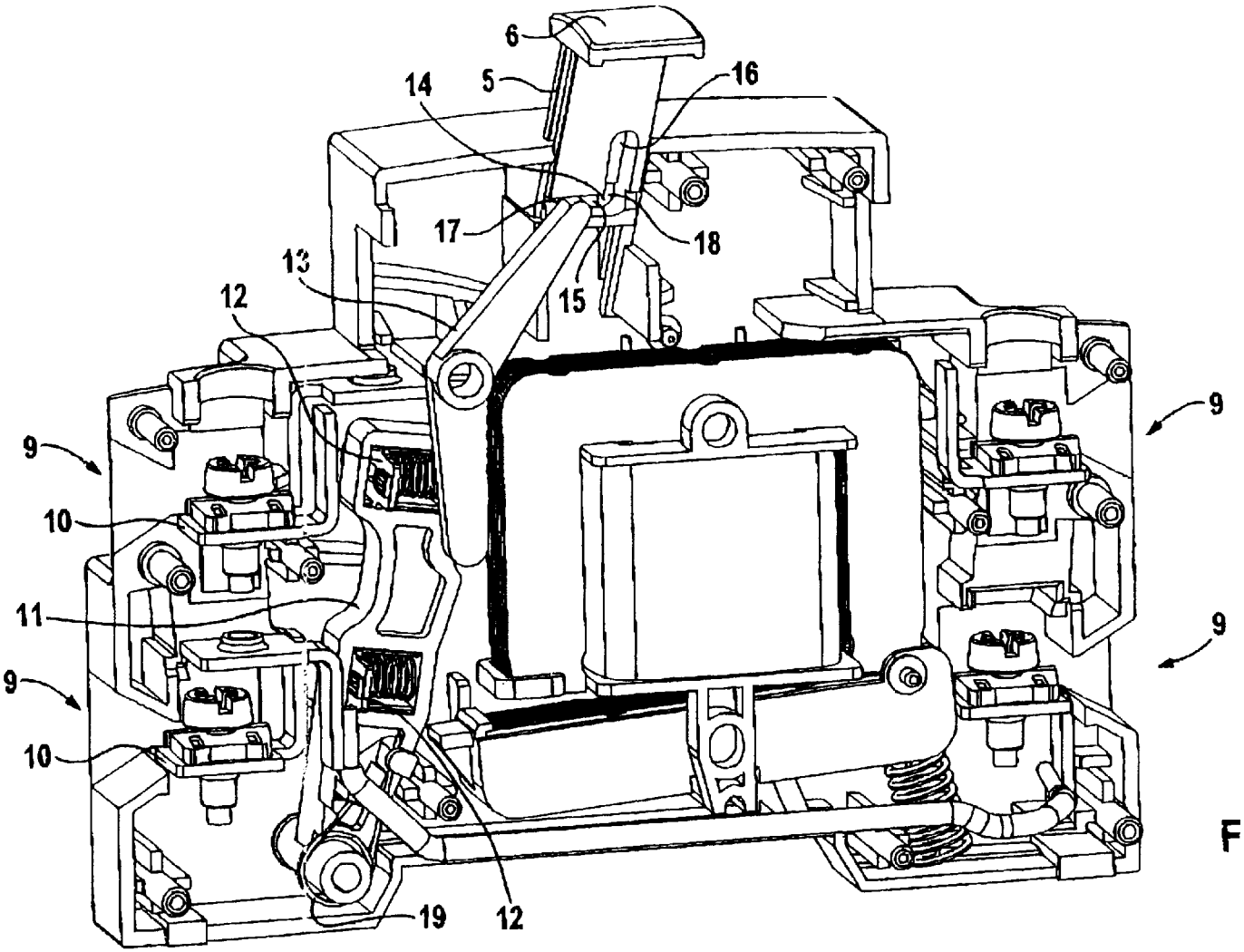
FIG. 2 shows an internal view of the leading auxiliary switch.

FIG. 2 shows an internal view of leading auxiliary switch 2, including an electromagnet system, a plurality of terminals 9, fixed contacts 10, a contact carrier 11 having moving contacts 12, a reversing lever 13 and slides 5 mentioned above. Reversing lever 13 is in operative connection with contact carrier 11 and also engages in a gate 14 on slide 5.

This gate 14 has two elongated contour sections 15 and 16 which are perpendicular to one another here but may also form an angle of 80° to 100° C. When slide 5 is depressed, reversing lever 13 slides first along contour section 15 parallel to the front wall of auxiliary switch 2 while also rotating and entraining contact carrier 11. Until the end of the first actuating phase, rear pin 17 (not shown here) on reversing lever 13 runs until it changes direction, pressing contact carrier 11 into the ON position where moving contacts 12 come in contact with fixed contacts 10. A small recess at the end of the longitudinal guide guarantees that slide 5 does not change its ON position even under the influence of vibration and impacts. In the second actuating phase of slide 5, pin 17 slides along second contour section 16, while reversing lever 13 retains the closed position of contacts 10, 12 unchanged. The second actuating phase of slide 5 thus begins at point 18 of the change in direction, with pressure face 6 at the same time reaching rocker 3 after traveling distance 7 (see FIG. 1). In the second actuating phase, rocker 3 is actuated by pressure face 6.

Thus, leading auxiliary switch 2 and switching device 1 having rocker 3 are closed by simply depressing slide 5.

On opening, the spring force of rocker 3 lifts actuating slide 5 to point 18 of the pin guide where it changes directions. Then it goes into its final resting position under the influence of a torsion spring 19 via reversing lever 13.

What is claimed is:

1. A switchgear unit, comprising:

a switching device including a first actuating element; and a leading auxiliary switch including moving contacts and fixed contacts, the auxiliary switch further including a second actuating element coupled to the switching device, the second actuating element including a slide having a gate which engages with a reversing lever, the slide being in operative connection with a contact carrier, the slide determining a position of the reversing lever in operation of the slide so that in a first actuating phase of the slide, the reversing lever brings the contact carrier into an ON position of the moving contacts with the fixed contacts, and in a second operating phase of the slide, the ON position of the reversing lever is maintained while the slide actuates the first actuating element, the second operating phase being subsequent to the first operating phase.

2. The switchgear unit according to claim 1, wherein in a direction of actuation of the slide, a first component of the slide is parallel to a mounting wall of the auxiliary switch.

3. The switchgear unit according to claim 1, wherein in a direction of actuation of the slide, a first component of the slide in a plane parallel to a front wall of the switching device.

4. The switchgear unit according to claim 1, two contour sections, the gate of the slide traveling through the two contour sections in the first and second actuating phases, the two contour sections forming an angle of 80° to 100° to one another.

5. The switchgear unit according to claim 1, wherein the first actuating element is a rocker.

6. The switchgear unit according to claim 1, further comprising:

a torsion spring lifting the slide away from the rocker in the first operating phase.

7. The switchgear unit according to claim 1, further comprising:

a torsion spring holding the slide in the ON position by frictional force in the second operating phase.

* * * * *